US007143966B2

(12) United States Patent
Liskow

(10) Patent No.: US 7,143,966 B2
(45) Date of Patent: Dec. 5, 2006

(54) FUEL INJECTOR

(75) Inventor: Uwe Liskow, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/140,038

(22) Filed: May 27, 2005

(65) Prior Publication Data

US 2005/0211226 A1 Sep. 29, 2005

Related U.S. Application Data

(62) Division of application No. 10/275,052, filed as application No. PCT/DE02/00692 on Feb. 27, 2002, now Pat. No. 6,899,291.

(30) Foreign Application Priority Data

Feb. 28, 2001 (DE) ..... 101 09 611

(51) Int. Cl.

| | |
|---|---|
| ***F02M 59/00*** | (2006.01) |
| ***F02M 61/00*** | (2006.01) |
| ***F02M 47/02*** | (2006.01) |
| ***F02M 61/20*** | (2006.01) |
| ***B05B 1/30*** | (2006.01) |

(52) U.S. Cl. ..... 239/533.2; 239/88; 239/89; 239/91; 239/533.9; 239/585.1; 239/585.5

(58) Field of Classification Search ..... 239/533.2, 239/88–93, 533.9, 533.3, 533.4, 533.11, 585.1–585.5; 251/129.15, 129.21, 127

See application file for complete search history.

(56) References Cited

U.S. PATENT DOCUMENTS 4,096,999 A * 6/1978 Eckert et al. ..... 239/533.5
4,836,454 A * 6/1989 Gaskell ..... 239/533.9
5,755,386 A 5/1998 Lavan et al.
5,996,911 A 12/1999 Gesk et al.
6,019,128 A 2/2000 Reiter
6,170,763 B1 1/2001 Fuchs et al.

FOREIGN PATENT DOCUMENTS

| | | |
|---|---|---|
| DE | 35 20 367 | 12/1986 |
| DE | 197 35 665 | 1/1999 |
| DE | 199 49 381 | 4/2000 |
| FR | 2 776 025 | 9/1999 |
| WO | WO 99/00595 | 1/1999 |
| WO | WO 99/31381 | 6/1999 |

* cited by examiner

*Primary Examiner*—Davis Hwu
(74) *Attorney, Agent, or Firm*—Kenyon & Kenyon LPP

(57) ABSTRACT

A fuel injector for the direct injection of fuel, especially into the combustion chamber of a mixture-compressing internal combustion engine having external ignition, is located in a cylinder head of the internal combustion engine in a receiving bore of the cylinder head, and includes a nozzle body and a sealing ring which seals the fuel injector from the cylinder head of the internal combustion engine. At an end on the discharge side of the fuel injector, an at least partially spherical body is formed which abuts at least partially against a wall of the receiving bore, a groove being circumferentially formed on the body in which the sealing ring is positioned.

5 Claims, 4 Drawing Sheets

FUEL INJECTOR

CROSS-REFERENCE TO RELATED APPLICATIONS

This application is a division of U.S. patent application Ser. No. 10/275,052, filed Apr. 16, 2003, now U.S. Pat. No. 6,899,291, which was the National Stage of PCT International Application No. PCT/DE02/00692, filed Feb. 27, 2002, each of which is expressly incorporated herein in its entirety by reference thereto.

FIELD OF THE INVENTION

The present invention relates to a fuel injector.

BACKGROUND INFORMATION

German Published Patent Application No. 197 35 665 describes a fuel injection system which has a compensating element made of a supporting body having a dome-shaped supporting surface. This compensating element supports a fuel injector in a receiving bore of a cylinder head. In the ring gap between the receiving bore and fuel injector, a sealing ring which seals the ring gap from the combustion chamber, is located in a groove in the fuel injector. Since the fuel injector rests on the spherically shaped calotte surface by way of a supporting surface, the fuel injector can be mounted at an angle that deviates from the axis of the receiving bore by up to a certain amount, and can be pressed firmly into the receiving bore using appropriate means, e.g., a clamping shoe. This allows a simple adaptation to be made to the fuel supply lines. As a result, tolerances may be compensated for in the manufacture and installation of the fuel injectors.

However, disadvantageous in the fuel injection system described in German Published Patent Application No. 197 35 665 is that the conventional arrangement, while it does allow a larger tolerance angle, only worsens the problem of sealing the ring gap between receiving bore and the fuel injector. This is because in the case of a larger tilting angle, the seal is produced only by the elasticity of the sealing ring, in that it has a large cross-sectional area and elasticity, and must provide sealing action even in the case of substantially uneven squeezing.

SUMMARY

In contrast, the fuel injector according to the present invention, may provide that a sealing effect of the sealing ring may be ensured even at large tilting angles, due to the sphere-segment shaped design of the body formed at the discharge-side end of the nozzle body, since the spherical body abuts against a calotte formed at a wall of the receiving bore by a large surface area.

Furthermore, the spring inserted between the fuel injector and the fuel distributor line, may ensure that leaks at a connection piece of the fuel distributor line are avoided and the axial displacement of the fuel injector may be held in check.

The sealing ring, depending on the form of the calotte, may be positioned at the equator or on the discharge side of the equator of the spherical body.

The formation of a recess and the slip-fitting of the spherical body onto the nozzle body are also features of the present invention. The conventional fuel injector may be inserted into the spherical body without modification, the original seal assuming the sealing between the nozzle body and the slip-fitted spherical body.

The calotte may be replaced by a conical beveling of the wall of the receiving bore, which facilitates the machining of the cylinder head. The uncomplicated machining of the cylinder head and the sealing effect of the calotte may also be combined by using an insert at which the calotte is formed, the insert being able to be pressed into the receiving bore. As a result, the sealing ring may even be dispensed with altogether, due to the compression effect.

Exemplary embodiments of the present invention are illustrated schematically in the drawings and are described in greater detail in the following description.

DETAILED DESCRIPTION

Figure 1:
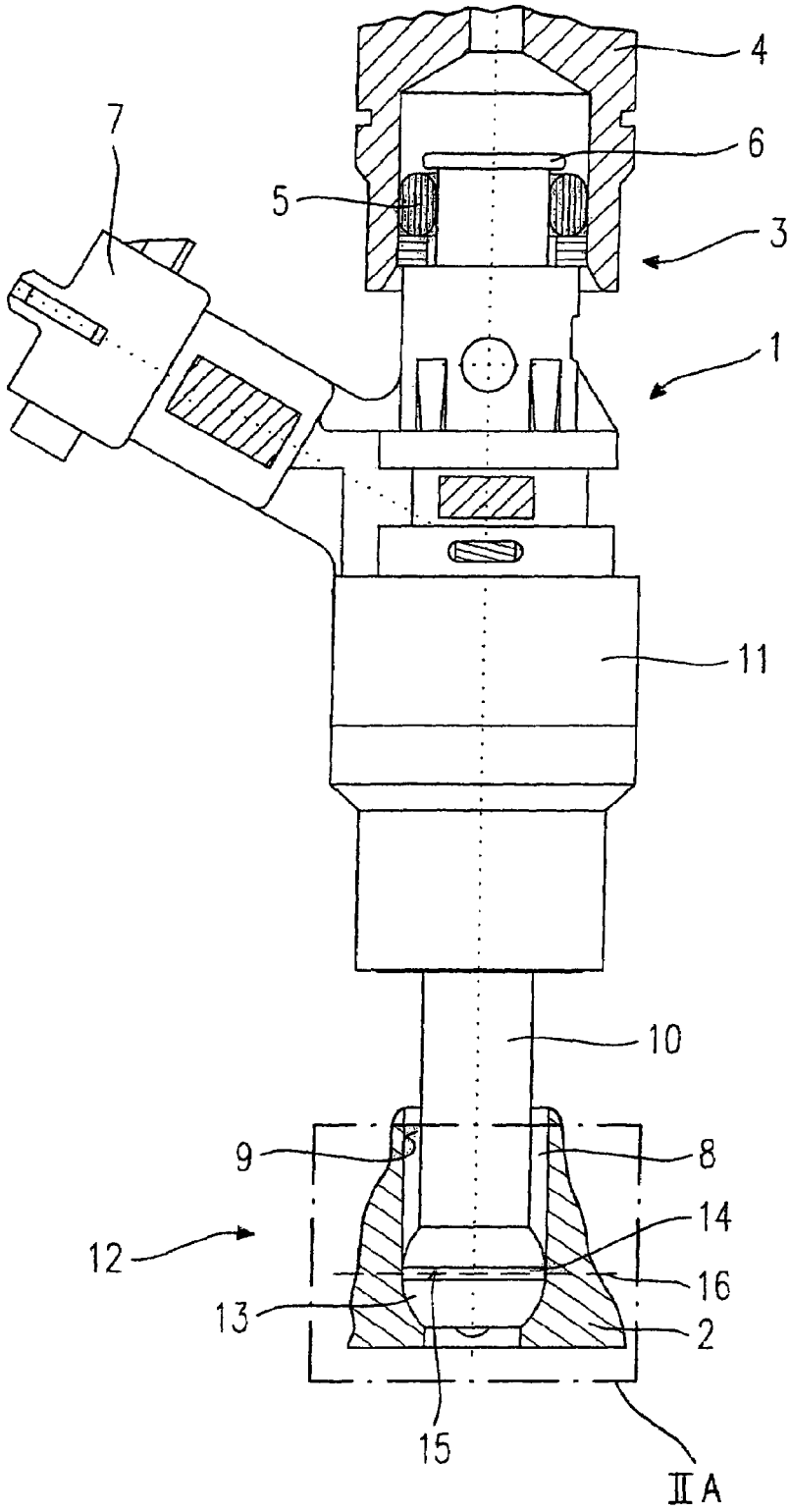
FIG. 1 is a schematic, part-sectional view of a first example embodiment of a fuel injector according to the present invention in a cylinder head of an internal combustion engine.

FIG. 1 shows a schematic partial section through an example embodiment of a fuel injector, designed in accordance with the present invention, in a receiving bore of a cylinder head of an internal combustion engine having external ignition.

A fuel injector 1 is designed in the form of a directly injecting fuel injector 1 and installed in a cylinder head 2 of an internal combustion engine. At an end 3 on the inflow-side, fuel injector 1 is provided with a plug connection to a fuel-distributor line 4, which is sealed by a seal 5 between fuel distributor line 4 and a supply connection 6 of fuel injector 1. Fuel injector 1 is provided with an electrical connection 7 for the electrical contacting to actuate fuel injector 1.

Fuel injector 1 is positioned in a receiving bore 8 of cylinder head 2 and has a nozzle body 10 and a valve housing 11. Valve housing 11 may supportively rest against a wall 9 of receiving bore 8. According to the present invention, at an end 12 on the discharge side, nozzle body 10 has a spherical body 13 which seals cylinder head 2 from the combustion chamber of the internal combustion engine using a sealing ring 14. Sealing ring 14 may be positioned in a groove 15, which is circumferentially formed at spherical body 13.

In the first example embodiment, terminal spherical body 13 is integrally formed with nozzle body 10. A detailed description of the first example embodiment may be inferred from the description relating to FIG. 2A.

Figure 2A:
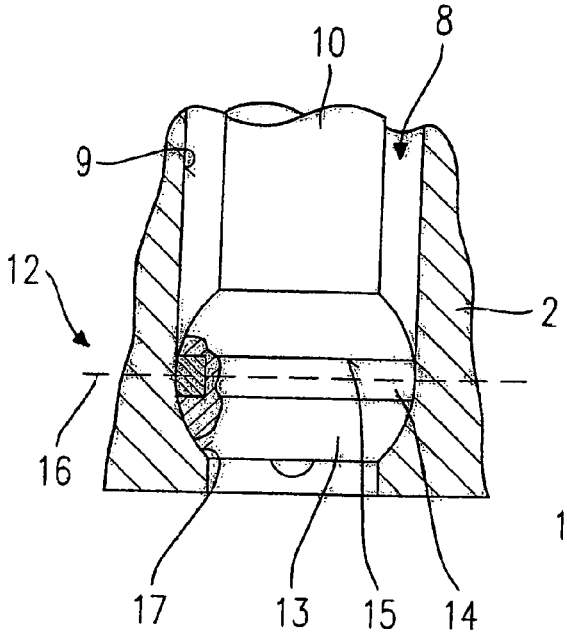
FIG. 2A illustrates a schematic cut-away portion of the fuel injector constructed according to the present invention as shown in FIG. 1, in the area IIA in FIG. 1.

FIG. 2A shows a schematic cut-away portion, in region IIA of FIG. 1, of the example embodiment of the fuel injector shown in FIG. 1. A partial section is shown in a cut-away view to clarify the measures of the present invention. Similar components have been provided with corresponding reference numerals in all figures.

Spherical body 13, which accommodates sealing ring 14, is formed on the discharge side of end 12 of fuel injector 1. In the present example embodiment, sealing ring 14 is positioned at an equator 16 of spherical body 13. Suitable materials for the manufacture of sealing ring 14 may be, for instance, Teflon® or copper, both of which are highly flexible and, therefore, easily adapted to the position of fuel injector 1 in receiving bore 8.

Receiving bore 8 of cylinder head 2 has a calotte 17 in which spherical body 13 abuts against wall 9 of receiving bore 8. Given a straight alignment of fuel injector 1, which is mounted in receiving bore 8 without displacement, sealing ring 14 abuts fully against calotte 17.

Should fuel injector 1 be displaced in receiving bore 8 of cylinder head 2, for instance, due to manufacturing tolerances of individual components or uneven warming of fuel injector 1 during operation, fuel injector 1 tilts relative to cylinder head 2, so that the position of sealing ring 14 at spherical body 13 relative to calotte 17 changes as well. However, because of the plasticity of the material of sealing ring 14, the displacement may be compensated for so that the sealing effect may be completely maintained.

Figure 2B:
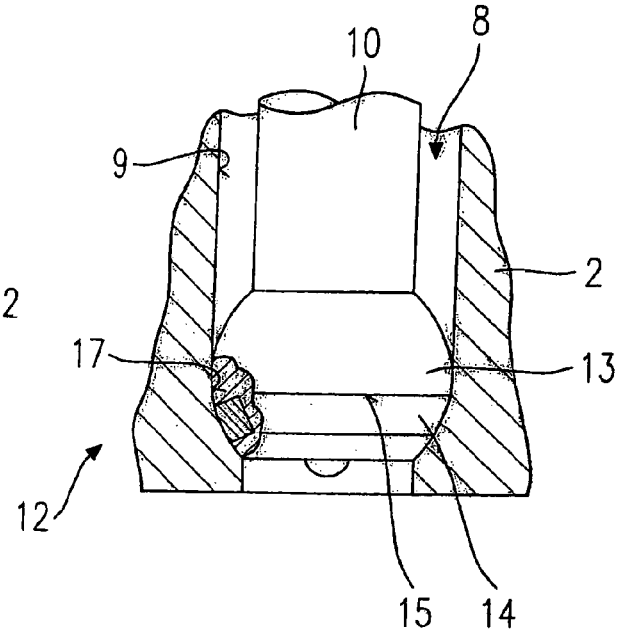
FIG. 2B illustrates a schematic cut-away portion of a second example embodiment of a fuel injector constructed according to the present invention, in the same area as FIG. 2A.

FIG. 2B shows schematic cut-away portion of a second example embodiment of a fuel injector designed in accordance with the present invention, in the same area as FIG. 2A.

The design of the second embodiment is similar to that of the example embodiments described in FIGS. 1 and 2A, sealing ring 14 now being positioned downstream from equator 16. Sealing ring 14 may be inserted into a circumferential groove 15 and, given a fuel injector 1 that is installed in a straight fashion, abuts directly against the bearing surface formed by calotte 17. Consequently, it may be possible to compensate even for displacements of greater magnitude. In order to offer an alternative volume for the material of sealing ring 14 when compensating for displacements, groove 15 may have an undercut volume, for instance, since sealing ring 14 may be deformed so that it is flush with spherical body 13. A groove 15 having a slightly larger diameter than sealing ring 14 may provide an alternative volume.

Figure 3A:
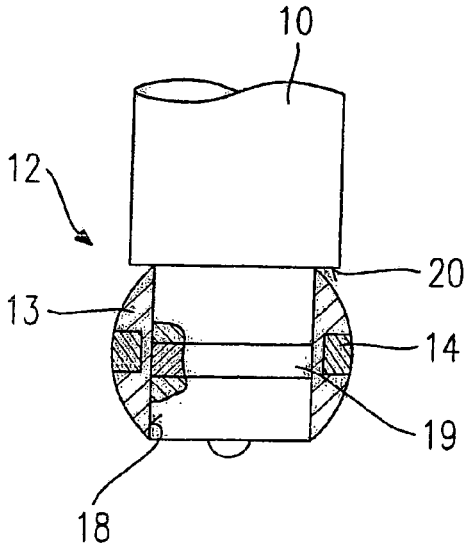
FIG. 3A illustrates a schematic cut-away portion of a third example embodiment of a fuel injector constructed according to the present invention.
Figure 3B:
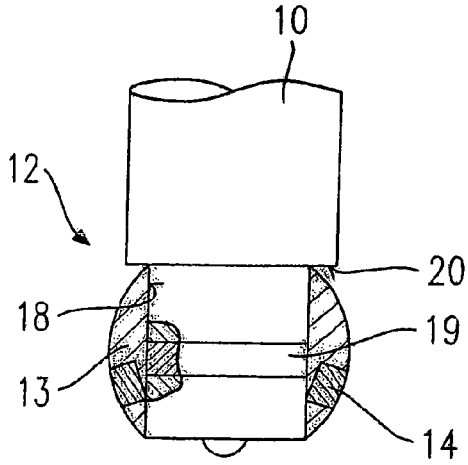
FIG. 3B illustrates a schematic cut-away section of a fourth example embodiment of a fuel injector constructed according to the present invention.

With respect to the placement of sealing ring 14, the example embodiments shown in FIGS. 3A and 3B may be similar to those represented in the example embodiments shown in FIGS. 2A and 2B. The third and fourth example embodiment have in common that spherical body 13 at end 12 on the downstream side of nozzle body 10 is not integrally formed with nozzle body 10. Instead, spherical body 13 has an inner recess 18 as a through opening into which downstream end 12 of nozzle body 10 is insertable. In this case, an additional sealing ring 19 may be placed between nozzle body 10 and spherical body 13 for sealing, so as to maintain the sealing effect between combustion chamber and cylinder head 2. A conventional placement of sealing ring 19 at nozzle body 10 need not be changed, but spherical body 13 may merely be slipped onto end 12 of nozzle body 10. Nozzle body 10 may require a contact flange 20 on which spherical body 13 may be supported.

Spherical body 13 may be mounted on end 12 of nozzle body 10 either by merely pressing it onto sealing ring 19, or by additionally securing it by a spot weld.

The spherical form of body 13 may only be produced in those areas that come into consideration as possible contact surfaces, depending on the tilting angle of fuel injector 1. Since this angle is limited, for instance, by the geometry of receiving bore 8 on the inflow side, it is not required that body 13 has an allover spherical design.

Figure 4:
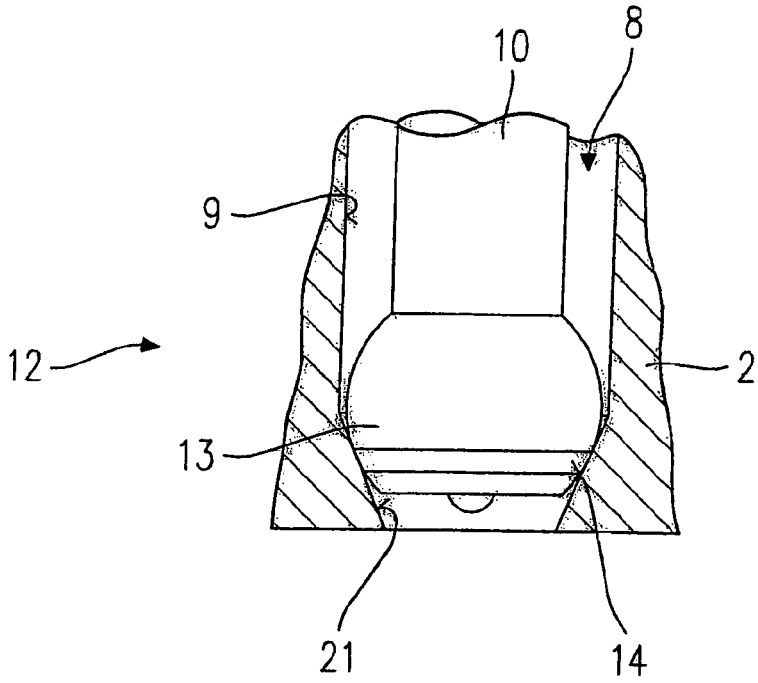
FIG. 4 illustrates a schematic cut-away section of a fifth example embodiment of a fuel injector constructed according to the present invention.

FIG. 4 shows a schematic cut-away section from a fifth example embodiment of a fuel injector constructed according to the present invention.

In contrast to the previous example embodiments, receiving bore 8 of cylinder head 2 is not provided with a calotte 17 in the region of downstream end 12 of nozzle body 10 of fuel injector 1, but merely a conical bevel 21. Since this arrangement provides a circumferential linear-shaped sealing surface, sealing ring may be positioned, as in the example embodiment shown in FIG. 2B, on the discharge side of equator 16 so as to achieve a reliable sealing effect. No special demands are made on the form of bevel 21; thus, the working of receiving bore 8 is correspondingly simple and inexpensive.

Figure 5:
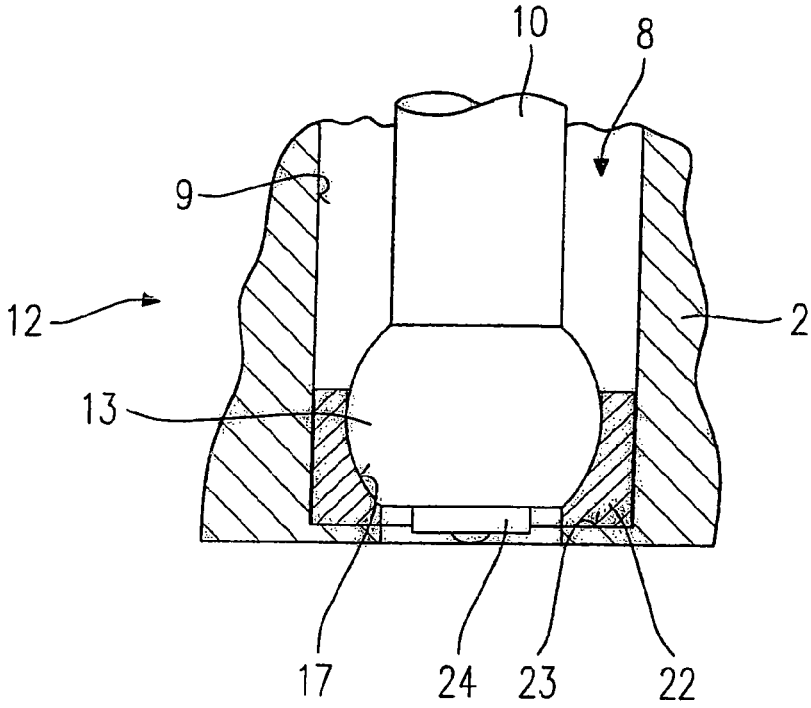
FIG. 5 illustrates a schematic section from a sixth example embodiment of a fuel injector constructed according to the present invention.

FIG. 5 shows a schematic cut-away section from a sixth example embodiment of a fuel injector 1 constructed according to the present invention.

The example embodiments described in FIGS. 1 to 3, due to the form of calotte 17 and the large contact surface resulting therefrom, may provide a high degree of sealing, even without sealing ring 14. This is utilized in the example embodiment shown in FIG. 5 insofar as calotte 17 is formed on an annular insert 22 that is pressed into receiving bore 8, which has a shoulder 23. In this manner, a straining of annular insert 22 may further contribute to the sealing effect, so that it is possible to dispense with a separate sealing ring 14 and a groove 15 as well.

In order to reduce the dead volume between the sealing region and the combustion chamber, fuel injector 1 shown in FIG. 5 is additionally provided with an elongation 24. This further measure may likewise be applied to the aforedescribed example embodiments and may be useful for reducing the dead volume in the fuel injectors 1 shown in FIGS. 2A, 2B, and 4.

Figure 6:
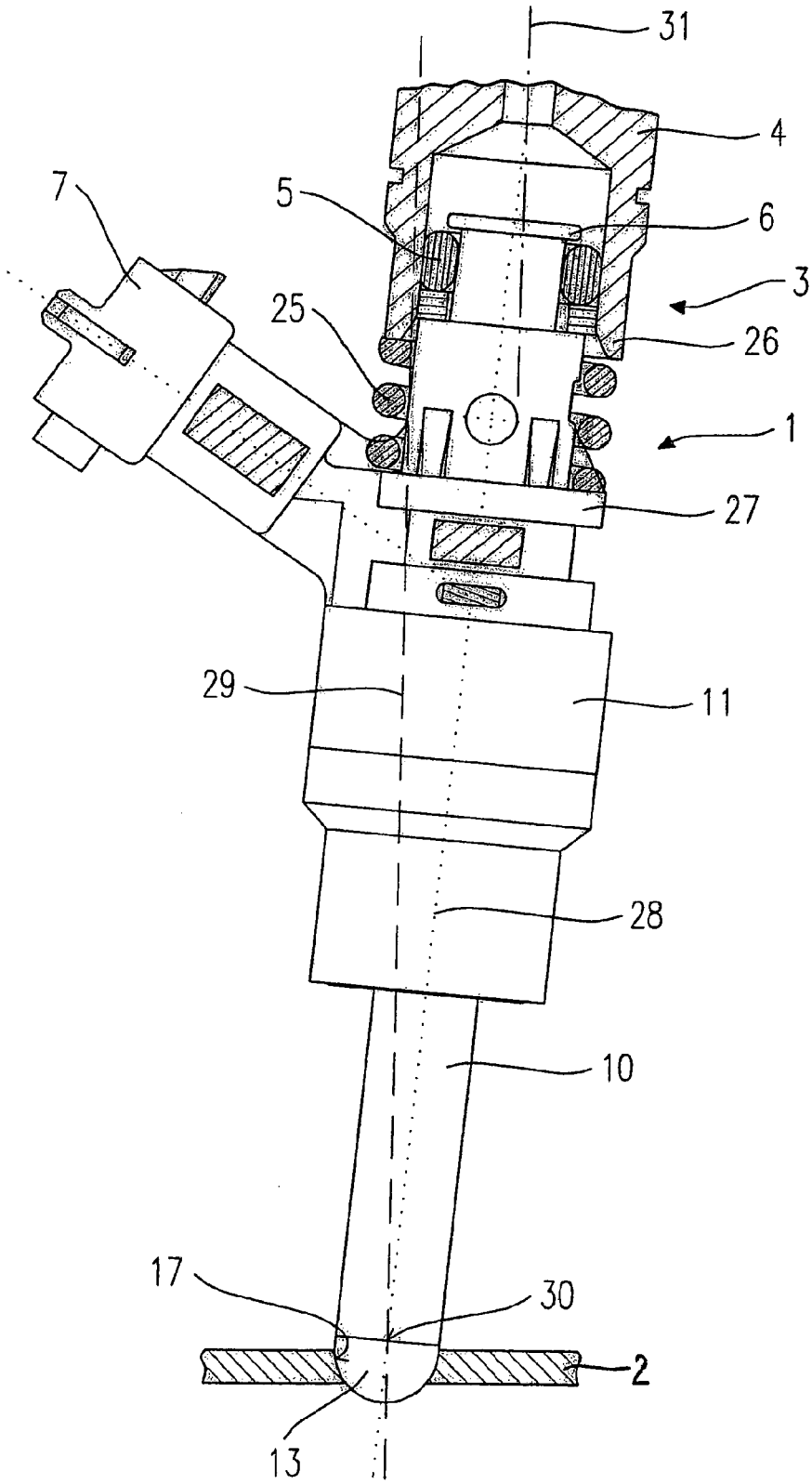
FIG. 6 is a schematic, part-sectional view of a seventh example embodiment of a fuel injector according to the present invention.

FIG. 6 shows a schematic, part-sectional view of a seventh example embodiment of a fuel injector 1 according to the present invention, in an overall view.

While the measures intended to compensate for displacements and misalignments of fuel injector 1 in receiving bore 8 of cylinder head 2 may be limited to end 12 of nozzle body 10 of fuel injector 1, the present example embodiment also provides a device for compensating offsets resulting from tilting or displacements of fuel injector 1 relative to fuel supply line 4.

This is a spring 25, which is clamped between a connecting piece 26 of fuel-distributor line 4 and a shoulder 27 of fuel injector 1.

If fuel injector 1, for example, due to manufacturing tolerances, is mounted in receiving bore 8 at a tilt, this may result in a radial displacement relative to connecting piece 26 of fuel-distributor line 4, which at times may assume considerable values. In FIG. 6, the possible displacements are marked using different axes. In this context, the dotted line marks a longitudinal axis 28 of fuel injector 1. As shown in FIG. 6, this may be tilted at an angle of 5°, for instance, relative to a general axis of symmetry 29 that is perpendicular to cylinder head 2, shown in FIG. 6, and which bisects longitudinal axis 28 of fuel injector 1 in an imaginary center point 30 of spherical body 13. This, in turn, results in a certain angular deviation of connecting piece 26 of fuel-distributor line 4 relative to supply piece 6 of fuel injector 1. Spring 25, according to the present invention, in connection with a spherical body 13, configured in accordance with the above-described example embodiments, at the downstream end 12 of fuel injector 1 is able to counteract the angular deviation to a certain degree. In FIG. 6, longitudinal axis 31 of connecting piece 26 of fuel-distributor line 4 is represented by a dash-dot line for better orientation.

The present invention is not limited to the example embodiments shown and is also applicable to fuel injectors for injection into the combustion chamber of an internal combustion engine having self-ignition.

What is claimed is:

1. A fuel injector for direct injection of fuel into a combustion chamber of an internal combustion engine, the fuel injector arranged in a receiving bore of a cylinder head of the internal combustion engine, comprising:

a nozzle body;

a sealing ring configured to seal the fuel injector from the cylinder head of the internal combustion engine;

a fuel-distributor line; and a spring clamped between the fuel-distributor line and the fuel injector and configured to enable the fuel injector to be elastically aligned in its position relative to connecting piece of the fuel-distributor line.

2. The fuel injector according to claim 1, wherein the combustion engine includes a mixture-compressing internal combustion engine having external ignition.

3. The fuel injector according to claim 1, wherein the spring is braced against the connecting piece of the fuel-distributor line at an upstream-side end of the fuel injector.

4. The fuel injector according to claim 1, wherein the spring is braced against a shoulder of the fuel injector at downstream-side end.

5. A fuel injector for direct injection of fuel into a combustion chamber of an internal combustion engine, the fuel injector arranged in a receiving bore of a cylinder head internal combustion engine, comprising:

a nozzle body;

a sealing ring configured to seal the fuel injector from the cylinder head of the internal combustion engine;

a fuel-distributor line; and a spring clamped between the fuel-distributor line and the fuel injector and configured to enable the fuel injector to be elastically aligned in its position relative to connecting piece of the fuel-distributor further comprising an at least partially spherical body disposed at a downstream-side end of the fuel injector and configured to at least partially abut against a wall of the receiving bore, the body including a receptacle circumferentially disposed on the at least partially spherical body and configured to receive the sealing ring.

* * * * *